US006439477B1

(12) United States Patent
Sweet et al.

(10) Patent No.: US 6,439,477 B1
(45) **Date of Patent: *Aug. 27, 2002**

(54) NUTATING SPRINKLER

(75) Inventors: Fred J. Sweet, College Place; Craig B. Nelson, Walla Walla, both of WA (US)

(73) Assignee: Nelson Irrigation Corporation, Walla Walla, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/697,485

(22) Filed: Oct. 27, 2000

Related U.S. Application Data

(63) Continuation-in-part of application No. 09/497,551, filed on Feb. 3, 2000.

(51) Int. Cl.[7] ..... B05B 3/04

(52) U.S. Cl. ..... 239/222.17; 239/214; 239/231; 239/381; 239/498; 239/505

(58) Field of Search ..... 239/214, 222.11, 239/222.17, 222.19, 225.1, 231, 380, 381, 382, 461, 524, 498, 505, 518, 232

(56) References Cited

U.S. PATENT DOCUMENTS

| | | | |
|---|---|---|---|
| 2,639,191 | A | 5/1953 | Hruby, Jr. |
| 2,848,276 | A | 8/1958 | Clearman |
| 2,963,228 | A | 12/1960 | Hait |
| 3,009,647 | A | 11/1961 | Hait |
| 3,009,648 | A | 11/1961 | Hait |
| 3,034,728 | A | 5/1962 | Hruby, Jr. |
| 3,091,400 | A | 5/1963 | Aubert |
| 3,312,400 | A | 4/1967 | Clearman |
| 3,532,273 | A | 10/1970 | Siddall et al. |
| 3,664,585 | A | 5/1972 | Curtis |
| 3,759,445 | A | 9/1973 | King |
| 4,011,917 | A | 3/1977 | Tiraspolsky et al. |
| 4,073,438 | A | 2/1978 | Meyer |
| 4,134,169 | A | 1/1979 | Sinclair |
| 4,290,557 | A | 9/1981 | Rosenberg |
| 4,356,972 | A | 11/1982 | Vikre |
| 4,487,368 | A | 12/1984 | Clearman |
| 4,883,228 | A | 11/1989 | Vydrzal et al. |
| 5,007,586 | A | 4/1991 | Cohen |
| 5,086,842 | A | 2/1992 | Cholet |
| 5,381,960 | A | 1/1995 | Sullivan et al. |
| 5,439,174 | A | 8/1995 | Sweet |
| 5,588,595 | A | 12/1996 | Sweet et al. |
| 5,671,885 | A | 9/1997 | Davisson |
| 5,681,109 | A | 10/1997 | Palmer |
| 5,765,945 | A | 6/1998 | Palmer |
| 5,950,927 | A | 9/1999 | Elliott et al. |
| 6,092,739 | A | 7/2000 | Clearman et al. |
| 6,129,293 | A | 10/2000 | Jägen |

*Primary Examiner*—Lesley D. Morris
*Assistant Examiner*—Christopher S. Kim
(74) *Attorney, Agent, or Firm*—Nixon & Vanderhye P.C.

(57) ABSTRACT

A nutating sprinkler assembly includes a sprinkler body having one end adapted to be coupled to a water supply conduit and an opposite end supporting a nozzle; at least one arm extending from the sprinkler body for supporting a removable cap assembly downstream of the nozzle, the cap assembly having a center body supporting a rotor plate having off-center grooves for distributing a stream exiting the nozzle and impinging upon the grooves. A spool bearing assembly having upper and lower bearing flanges is supported in the cap center body, and the center body mounts an interior ring loosely confining the spool bearing assembly and the rotor plate. The center body has an end wall formed with a post extending toward and received within a cavity of a lower spool bearing component of the spool bearing assembly when the rotor plate is in an at-rest position, thereby creating an unstable arrangement causing the rotor plate to tilt to an off-center position. The lower spool bearing component is comprised of a relatively heavy material for balancing the rotor plate and the spool bearing assembly about a center of nutation.

19 Claims, 9 Drawing Sheets

NUTATING SPRINKLER

RELATED APPLICATIONS

This application is a continuation-in-part of application Ser. No. 09/497,551 filed Feb. 3, 2000.

TECHNICAL FIELD

This invention relates to sprinkler devices and more specifically, to an improved sprinkler which incorporates a spray plate (or rotor plate) mounted for wobbling/rotating motion referred to herein as "nutation."

BACKGROUND

Moving irrigation systems such as conventional pivot or linear systems are known to incorporate conduit truss span assemblies which mount sprinkler heads, spaced along the truss assemblies for sprinkling or irrigating relatively large areas of land. The sprinkling heads may be mounted on top of the truss assemblies in a normal upright position, or they may be inverted and suspended from the span assemblies by means of drop tubes. Sprinkler heads are typically of the spinner type, which incorporate rotatable stream distributors (also referred to as rotor plates or spray plates, fixed spray plates or bubbler devices).

When irrigating large areas of land with pivot or linear sprinklers, the sprinklers need to be spaced apart as far as possible to minimize system hardware costs. To obtain an even distribution of the water at wide spacings requires sprinklers that simultaneously throw the water long distances and produce sprinkling patterns that are very even when overlapped with adjacent sprinklers. These two requirements are somewhat exclusive in that maximum radius of throw is achieved with concentrated streams of water shooting at relatively high trajectory angles. These streams, however, tend to produce a donut shaped sprinkling pattern at low pressure that does not overlap evenly. The use of nutating or wobbling sprinklers to enhance distribution uniformity particularly at low pressure is known in the art, as evidenced, for example, by U.S. Pat. Nos. 5,439,174; 5,671,885; and 5,588,595. Wobbling type sprinklers can be problematic, however, in the sense that in some circumstances, the sprinkler simply rotates on its center axis without wobbling. This is particularly true if the sprinkler rotor plate is allowed to assume an on-center orientation when at rest.

A recently issued U.S. Pat. No. 5,950,927, addresses this problem by mechanically constraining the rotor plate to always assume an off-center position.

SUMMARY OF THE INVENTION

This invention provides an improved rotor plate mounting arrangement in a nutating sprinkler which insures that the rotor plate will be tilted to an off-center position on start-up, thereby also insuring that the rotor plate will exhibit the desired nutating motion.

In a first exemplary embodiment, the rotor plate is supported in a center body of a removable cap assembly secured to a sprinkler body, with the rotor plate downstream of a fixed nozzle. The rotor plate is fixed to a hub protruding from the center of one side of a load disc captured loosely between a pair of annular rings located within the centerbody. In this embodiment, the hub includes a shaft extending into the rotor plate. At the same time, a tilter button or post projects upwardly toward the opposite side of the load disc and engages a center portion of the disc when the sprinkler is at an at rest position. Because of the inherently unstable nature of the engagement, i.e., where a top heavy rotor plate is supported essentially on a point contact, the rotor plate will tilt to one side. When water is supplied to the sprinkler, the rotor plate will rotate and wobble, i.e., nutate, in the desired manner, and the rotor plate will also separate slightly from the tilter button or post, thus reducing the potential for wear on the post. In this first embodiment, the tilter button or post is incorporated in a plug which is threaded into a cap center body which supports the rotor plate. In another variation of this embodiment, the tilter button or post is incorporated in a cover or plate secured to the center body by one or more fasteners.

In a second exemplary embodiment of the invention, the hub includes a spool and a shaft projecting from one side of the spool, with the other end of the shaft fixed in the rotor plate. The spool has upper and lower flanges, and an internal annular ring in the cap centerbody loosely supports the spool in an area between the upper and lower flanges. A tilter button or post extends vertically into a center recess in the other side of the spool, creating an unstable mounting arrangement as described hereinabove. Here again, the rotor plate assumes a tilted or off-center position when at rest, insuring that the desired nutating motion will occur on start-up.

In a third embodiment of the invention, the rotor plate is formed with an open-ended cylindrical stem which receives a relatively large diameter hub projecting from the center of one side of a load disc. In this embodiment, the load disc is captured between a pair of discrete, annular rings sandwiched between an interior shoulder in the cap center body and the cap cover or plug. As in the earlier described embodiments, a tilter button or post is formed integrally with the cover or plug and engages a center recess in the other side of the load disc.

In a fourth embodiment of the invention, an open cylindrical stem of the rotor plate receives a hub projecting from one side of a spool loosely captured within the cap center body by an internal ring or flange. The upper and lower spool flanges may be snap-fitted together, sandwiching a wear resistant spool bushing therebetween. The internal ring is held in place in the center body by the cover or plug which includes an integral post or tilter button projecting into a center recess in the other side of the spool.

In a fifth and preferred embodiment of the invention, the open cylindrical stem of the rotor plate receives an upper spool component of a spool bearing assembly. This upper spool component is re-shaped to incorporate an umbrella-like shield over the spool or spindle bearing assembly to prevent dirt or debris from entering the bearing area. The lower spool or spindle component is made of brass and is shaped and sized to have sufficient mass to statically balance the moving parts about the center of nutation, while still producing the instability vis-a-vis the post that insures an off-center at rest position of the rotor plate.

Other advantages and improvements will be explained in further detail below.

Accordingly, in one aspect, the present invention relates to a nutating sprinkler assembly comprising a sprinkler body having one end adapted to be coupled to a water supply conduit and an opposite end supporting a nozzle; at least one arm extending from the sprinkler body for supporting a removable cap assembly downstream of the nozzle, the cap assembly having a center body supporting a rotor plate having off-center grooves for distributing a stream exiting the nozzle and impinging upon the grooves; a hub secured to the rotor body and comprising a spool bearing assembly having upper and lower bearing flanges; the center body mounting an interior ring loosely confining the spool bearing assembly between the upper and lower bearing flanges; the center body having an end wall formed with a post extending toward and received within a cavity of a post bearing component when the rotor plate is in an at-rest position, thereby creating an unstable arrangement causing the rotor plate to tilt to an off-center position, the spool bearing component comprised of a relatively heavy material for balancing the hub and the rotor body during nutation.

DETAILED DESCRIPTION OF THE DRAWINGS

Figure 1:
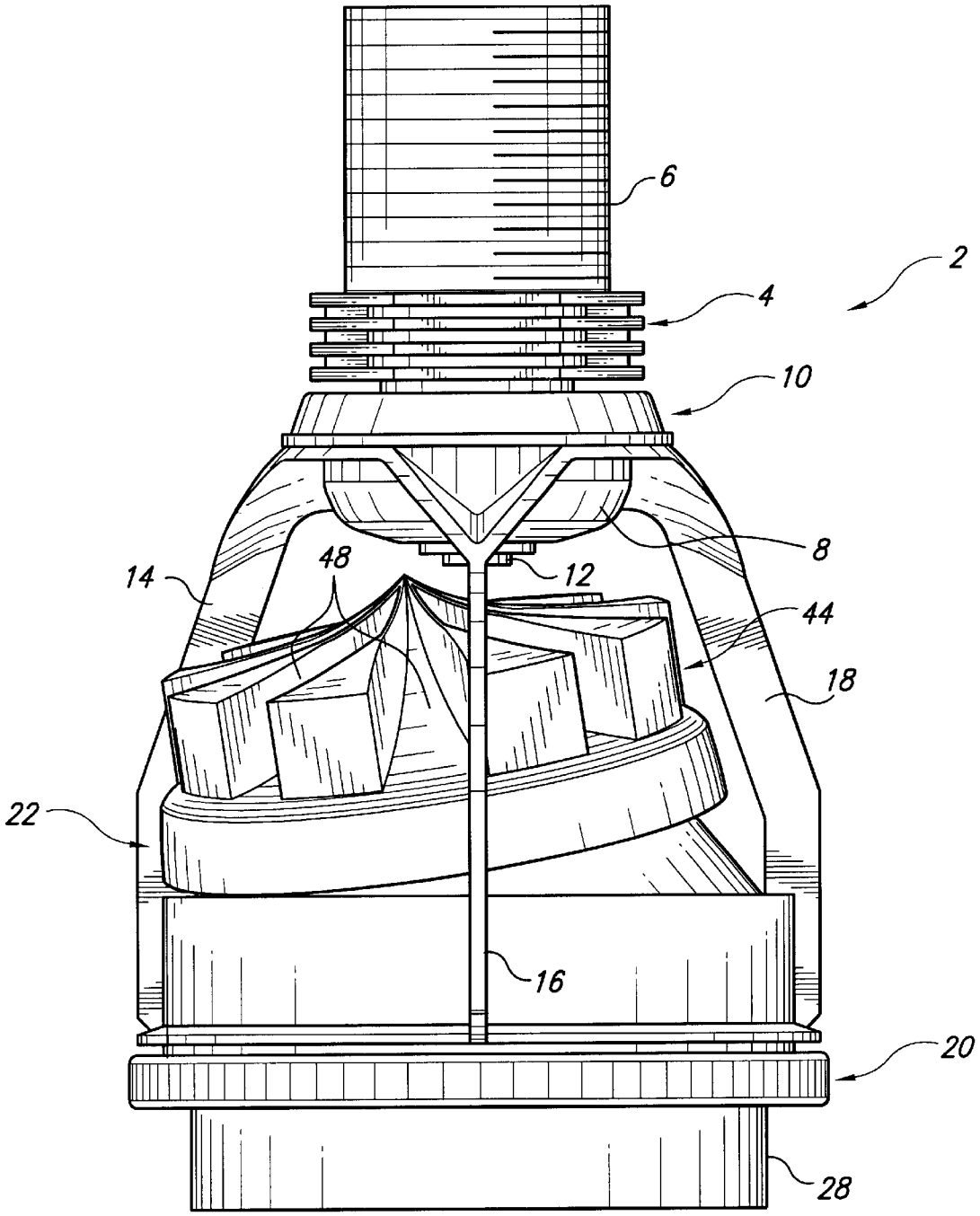
FIG. 1 is a side elevation of a rotatable sprinkler incorporating a nutating rotor plate in accordance with the first exemplary embodiment of the invention.

Referring to FIG. 1, the sprinkler 2 includes an adapter 4 having a threaded inlet 6 to be secured to a coupling or conduit (not shown). The outlet end of adapter 4 has a unique external thread that engages sprinkler body 8. A fixed nozzle 10 is captured between the outlet end of adapter 4 and the sprinkler body 8, the nozzle having a discharge orifice 12. Arms 14, 16 and 18 extend from the sprinkler body and support a removable cap assembly 20 which, in turn, supports a nutator assembly 22 within a central opening in the cap assembly. The nutator assembly may be press-fit in the opening and held in place by an annular rib adapted to seat within a complementary groove defined by shoulder 24 and rib 26 formed on the nutating assembly centerbody 28. It will be appreciated, however, that the nutator assembly can be secured relative to the nozzle by any suitable means.

Figure 2:
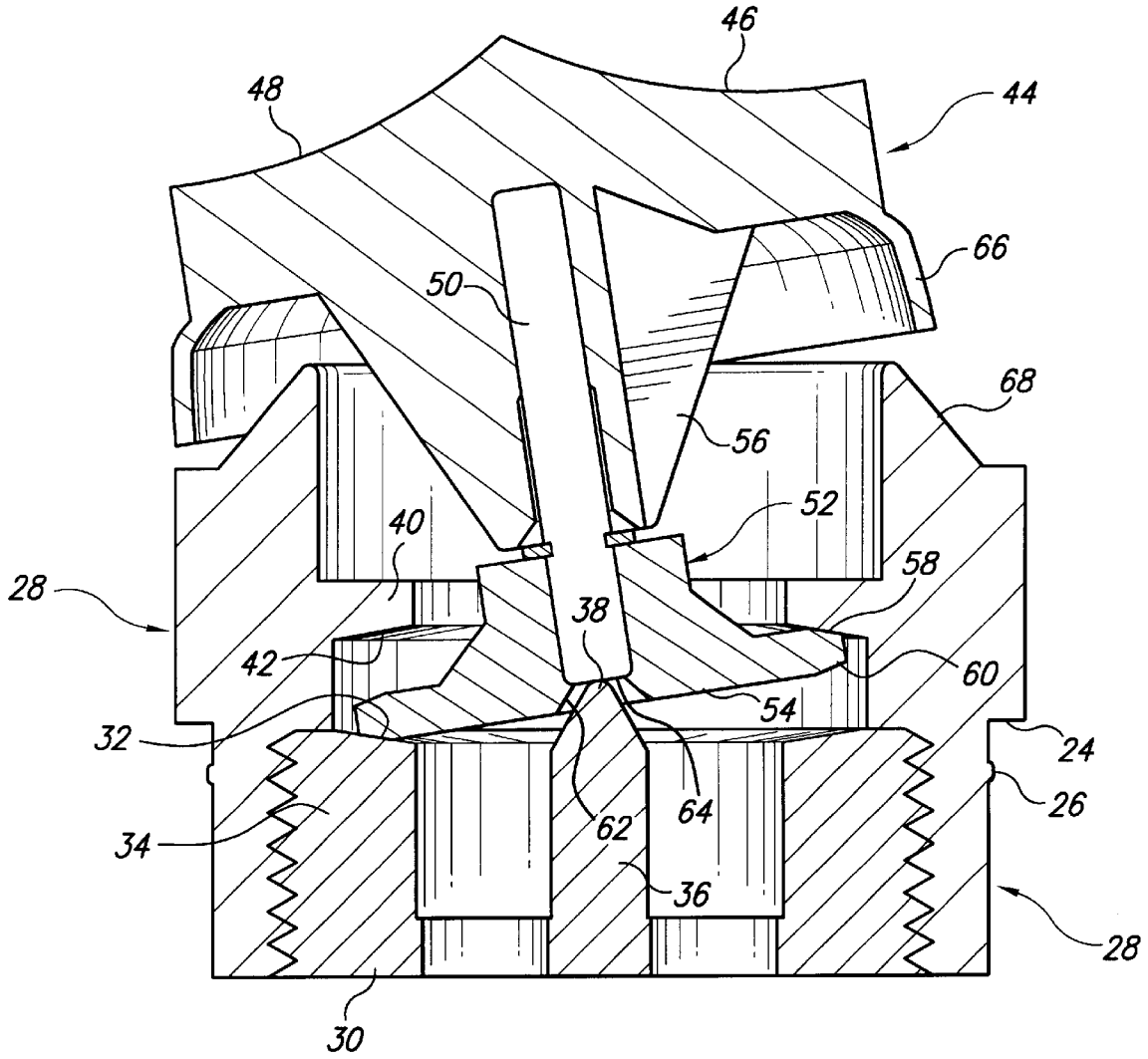
FIG. 2 is an enlarged detail taken from FIG. 1.

With reference also to FIG. 2, the centerbody 28 includes a plug 30 threaded into one end of the centerbody, the plug having an internal peripheral inclined surface 32 about its inner end 34. The plug is also formed with a tilter button or post 36 having rounded point or tip 38 at its free end. The cap centerbody 28 also includes an interior annular flange 40, one surface 42 of which is also slightly inclined in the radial direction.

A rotor plate 44 includes a rotor body 46 having a series of water deflecting grooves 48 therein which are circumferentially offset to cause the rotor plate to rotate when a stream from the nozzle 16 impinges on the grooves 48. A shaft 50 extends from a hub 52 projecting from the center of a one side of load disc 54. The other end of the shaft is received in a stem 56 of the rotor body 46. The load disc 54 has opposed inner and outer peripheral surfaces 58, 60 adapted to cooperate with surfaces 42, 32, respectively. A center recess 62 on the other side of the load disc 54 exposes the shaft bottom 64. The load disc 54 is loosely captured between the surface 42 of flange 40 and the inner surface 32 of the plug 30.

When at rest, the shaft bottom 64 rests on the point or tip 38 of the tilter button 36, creating an inherently top-heavy, unstable arrangement, that causes the rotor plate 44, shaft 50 and load disc 54 to tilt to one side, as best seen in FIG. 2. Notice that surface 58 of disc 54 is not engaged with surface 42 of ring 40.

When water is supplied to the sprinkler 2, the instability of the rotor plate vis-a-vis the tilter button 36 insures that rotor plate 44 will begin nutating (or wobbling) as it rotates, and not merely assume a stable, on-center position. As the rotor plate 44 begins to rotate, the tilting action will increase to the extent that both of the opposed surfaces 58, 60 on the load disc 54 will engage respective surfaces 42 of flange 40 and 32 of the plug 30. With this additional degree of tilt, illustrated in FIG. 3, the shaft bottom 64 will separate slightly from the tilter button 36, minimizing wear on the tilter button. The degree of tilt when the rotor plate is rotating may be about 10° to 12°.

It will also be appreciated that annular skirt 66 extending from the rotor plate 44, and annular surface 68 at the inner end of the cap centerbody 24 cooperate to minimize intrusion of any debris into the area of the hub 52 and load disc 54.

While the assembly is shown in FIG. 1 and FIG. 2 oriented so as to receive a stream from above rotor plate 44, it will be appreciated that the assembly may be inverted so that the stream rotor plate "hangs" by means of load disc 54. The sprinkler nevertheless operates in substantially the same manner as described above, except that on start-up, the stream will push the rotor body 46 upwardly, causing the shaft bottom 64 to engage the tilter button 36. Again, the instability of the arrangement will cause the rotor plate 44 to tilt, insuring the desired nutating motion will commence when the stream impinges on the grooves 48 of the rotor plate.

Wear resistant coatings or materials may be used as desired to reduce wear at the points of engagement of the load disc 54 with the surface 42 of the flange 40 and surface 32 of plug 30.

Figure 3:
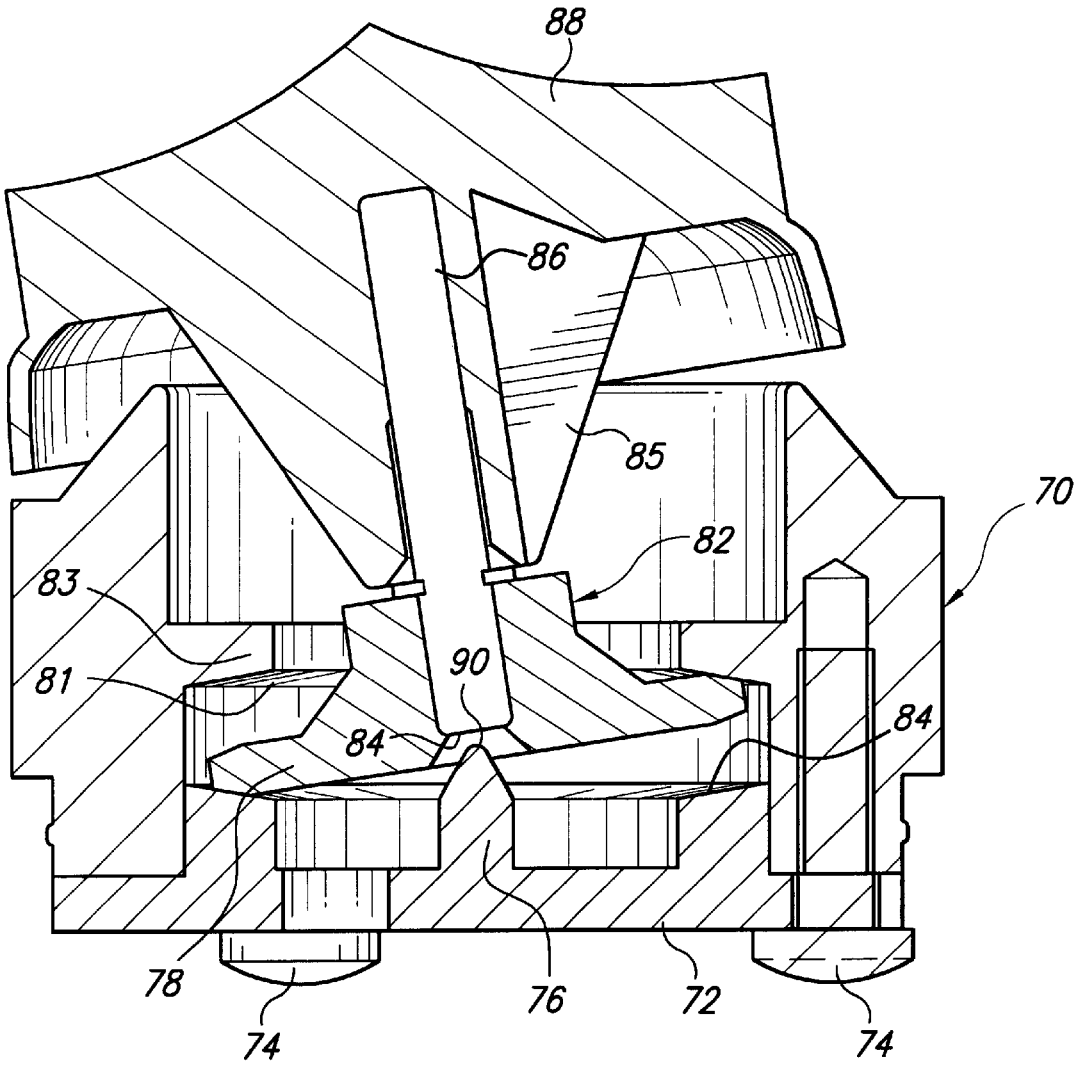
FIG. 3 is an enlarged detail of a variation of the rotor plate assembly shown in FIGS. 1 and 2.

In an alternative arrangement illustrated in FIG. 3, a cap centerbody 70 is axially shortened and the plug 30 is replaced by a cap cover or plate 72 fastened to the cap centerbody 70 via circumferentially spaced screws 74. A tilter button 76 extends inwardly from the cap cover 72, extending toward one side of a load disc 78. The load disc 78 is formed integrally with the hub 82 and is loosely captured between the lower surface 81 of the interior annular flange 83 and an interior peripheral surface 84 on the cap cover 72. The device is otherwise similar in construction and operation to the first exemplary embodiment shown in FIGS. 1 and 2, noting that hub 82 includes a shaft 86 that extends into the stem 85 of the rotor body 88. As already noted, FIG. 3 illustrates the position of load disc 78 during rotation, when it (and the bottom 84 of shaft 86) separate slightly from the tip 90 of tilter button 76.

Figure 4:
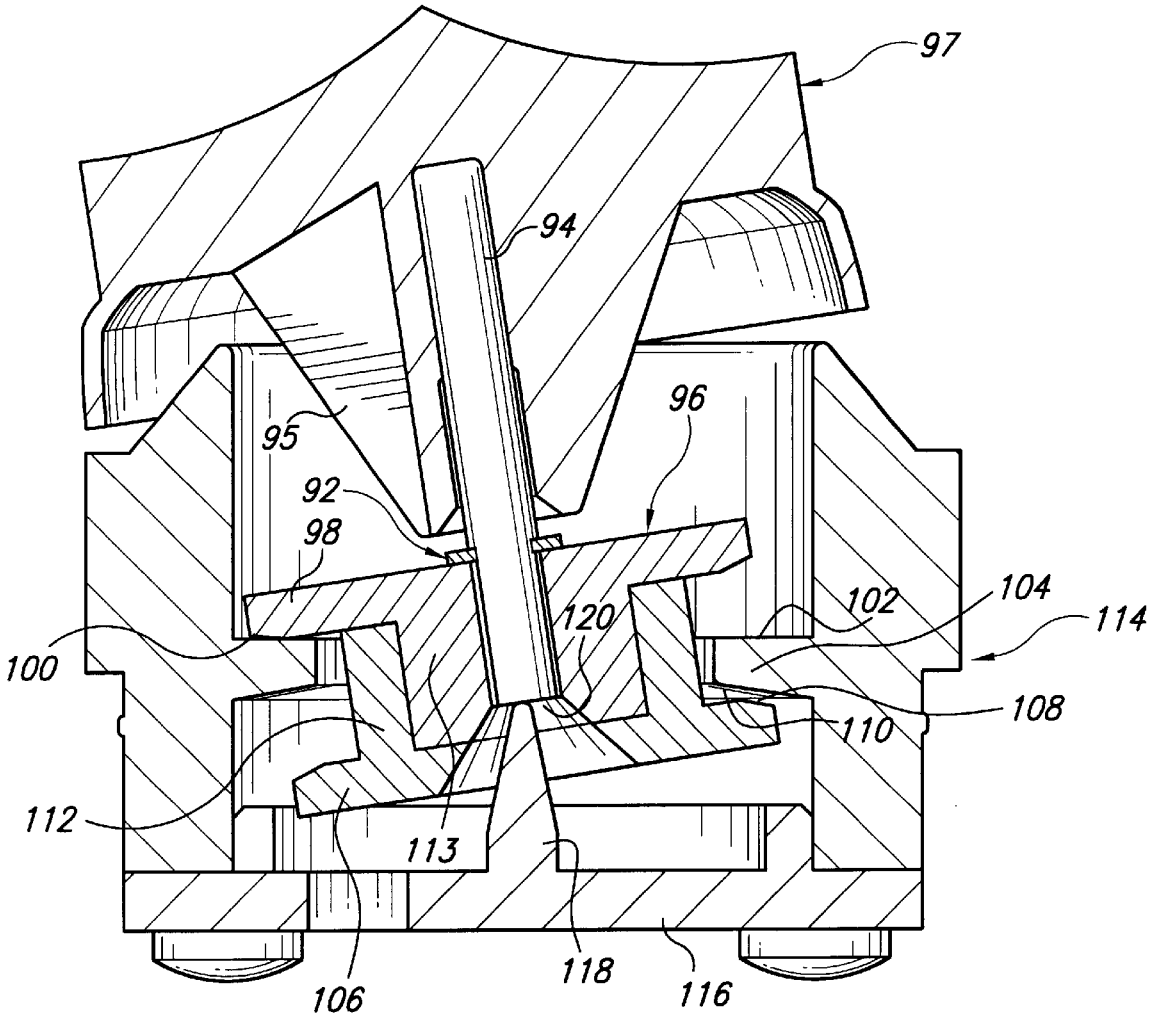
FIG. 4 is a cross section of a rotor plate assembly in accordance with a second exemplary embodiment of the invention.

In a second embodiment of the invention illustrated in FIG. 4, the hub 92 includes a shaft 94 extending from a two-piece spool 96, and received in a stem 95 of the rotor body 97. The spool 96 includes a first or upper flange 98 providing a first peripheral surface 100 adapted to engage a first facing surface 102 of the inner flange ring 104. The spool also includes a second or lower flange 106 providing a second peripheral surface 108 adapted to engage the undersurface 110 of the inner flange ring 104. The cylindrical portion 112 is integrally formed with the flange 106 telescopes over the center portion 113 integrally formed with the first or upper flange 98.

The cap center body 114, is closed by a cap cover or plate 116 and includes an integral tilter button 118 adapted to engage the shaft bottom 120 when the sprinkler is at rest. Note that the spool 96 does not engage any interior surface of cover 116 other than the tilter button 118. The structure shown in FIG. 4 is otherwise similar in construction and operation to the above described alternative embodiments.

Figure 5:
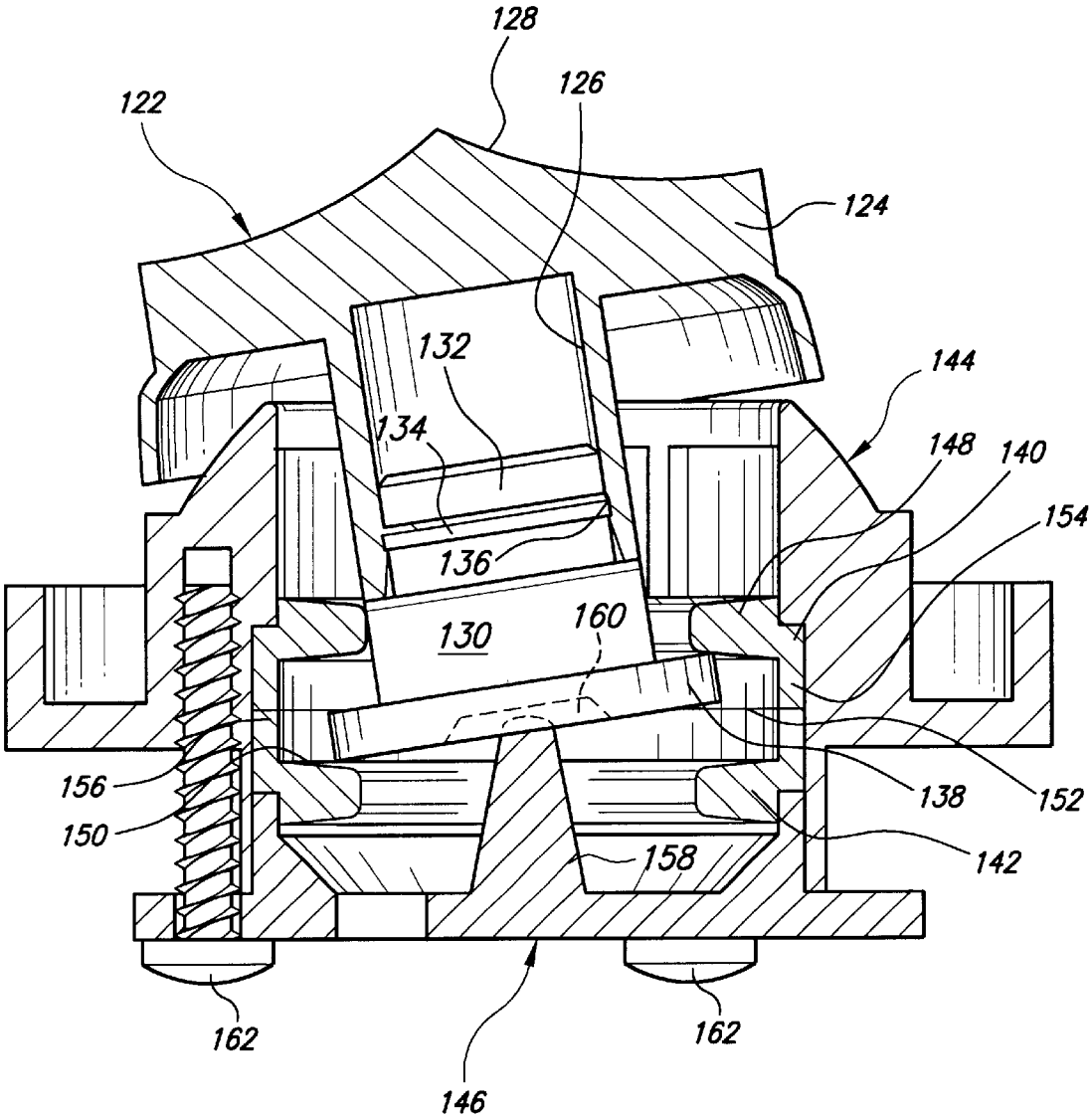
FIG. 5 is a cross section of a rotor plate assembly in accordance with a third exemplary embodiment of the invention.

Turning now to FIG. 5, a third exemplary embodiment of the invention is disclosed in which modifications are made with respect to the manner in which the rotor plate is connected to the load disc. Specifically, the rotor plate 122 incorporates a rotor body 124 having an open-ended cylindrical stem 126 extending away from the grooves 128 in the external surface of the rotor plate. The stem is adapted to receive in snap-fit relationship a hub 130 which includes a reduced diameter projection 132 having an annular rib 134 adapted to cooperate with a groove 136 in the stem 126, facilitating the snap-fit relationship within the stem. The load disc 138 is formed integrally with the hub and is loosely confined between a pair of discrete annular rings 140 and 142 sandwiched between the cap centerbody 144 and the cap end cover or plug 146. These annular rings are preferably formed of a wear resistant plastic material with a radial surface 148 of the upper ring cooperating with a radial surface 150 of the lower ring to confine the load disc 138 therebetween. The two annular rings 140, 142 join at an interface 152 defined by the edges of axial portions 154, 156, respectively, of the rings, and it will be appreciated that the rings must be separable in order to permit the assembly of the hub 130 within the cap centerbody 144. The end cover or plug 146 incorporates an integral tilter button or post 158, the free end of which engages within a center recess 160 formed in the lower side of the load disc 138. The cap end cover or plug 146 may be secured to the cap centerbody by a plurality of screws 162. The manner of operation of the rotor plate and the load disc vis-a-vis the tilter button is otherwise similar to the previously described embodiments.

Figure 6:
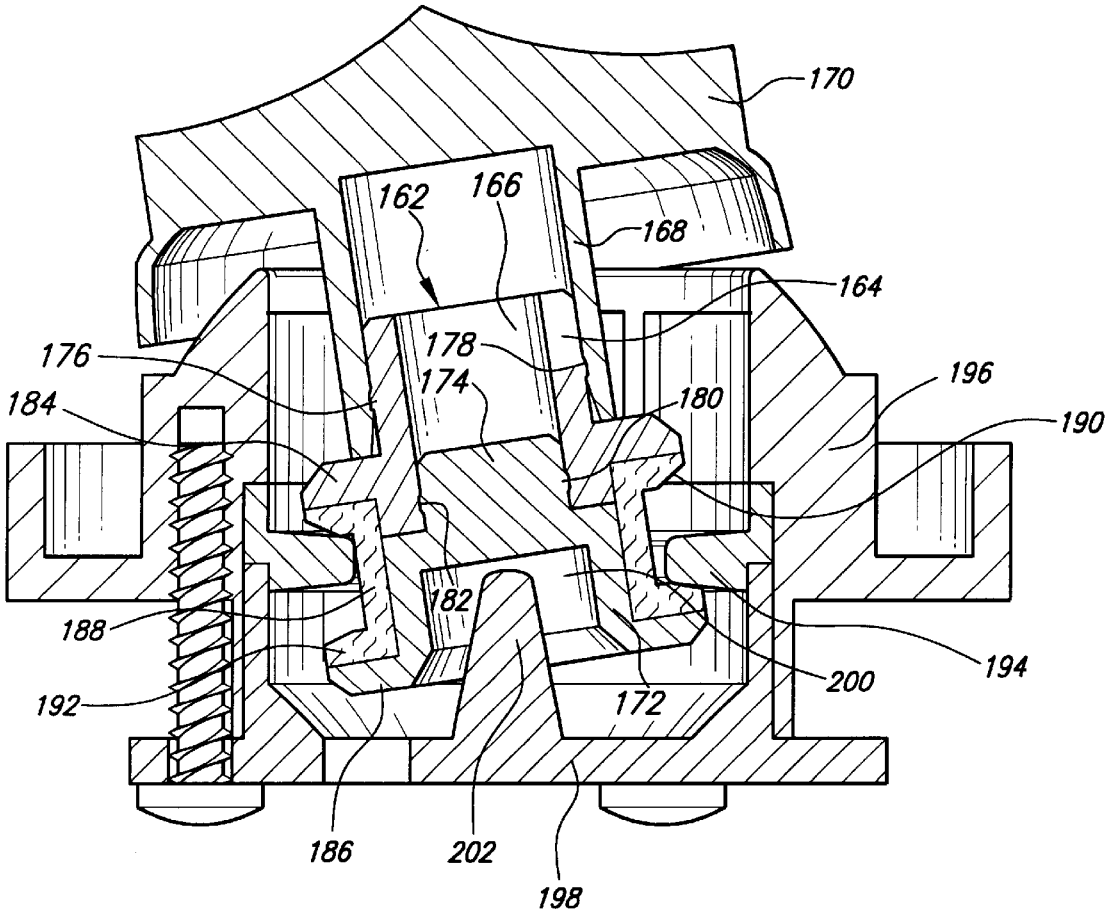
FIG. 6 is a cross section of a rotor plate assembly in accordance with a fourth embodiment of the invention.

FIG. 6 illustrates yet another embodiment of the subject invention, generally combining the features disclosed with respect to the embodiment illustrated in FIG. 4 and the features illustrated in FIG. 5. Thus, the hub 162 is formed as a two-piece spool, with an upper part 164 of the spool including a hollow cylindrical projection 166 adapted to be snap-fit within the open-ended cylindrical stem 168 projecting away from the rotor body 170. A lower spool element 172 is snap-fit within the upper spool element, with a solid projection 174 extending into the center opening of the spool upper part 164. An annular rib 176 on the projection 166 adapted to seal in a complementary groove 178 in the stem 168 facilitates attachment of the upper spool element to the stem, while an annular rib 180 formed on the solid projection 174 of the lower spool element cooperates with a complementary groove 182 in the upper spool part 164 facilitates connection of the lower spool element 172 to the upper spool element.

Between the opposing flanges 184 and 186 of the upper and lower spool elements, respectively, there is a conforming wear element or bushing 188 (made of any suitable wear resistant material) which also includes upper and lower wear surfaces 190 and 192, respectively. These upper and lower surfaces of the wear element are loosely confined by an internal annular ring 194 seated within the cap centerbody 196 and held in place by the end cover or cap 198. The annular ring 194 may also be made of a wear resistant plastic.

The lower spool element 172 is formed with a center recess 200 adapted to receive a tilter button or post 202 extending upwardly from the end cover or plug 198. This device operates in a manner similar to the embodiment illustrated in FIG. 4 as explained hereinabove.

Figure 7:
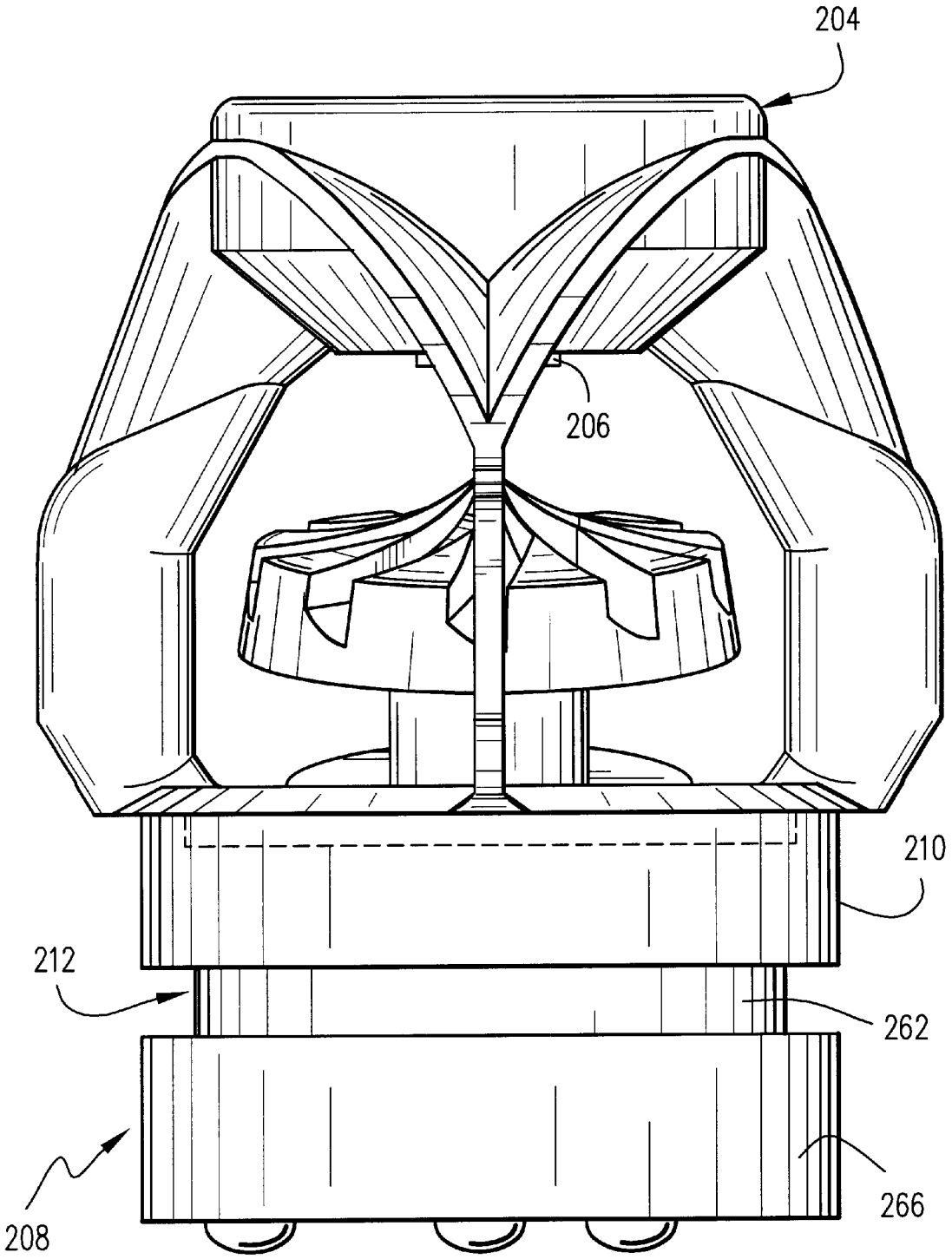
FIG. 7 is a side elevation of a sprinkler incorporating a nutating rotor plate in accordance with a fifth and preferred embodiment of the invention.
Figure 8:
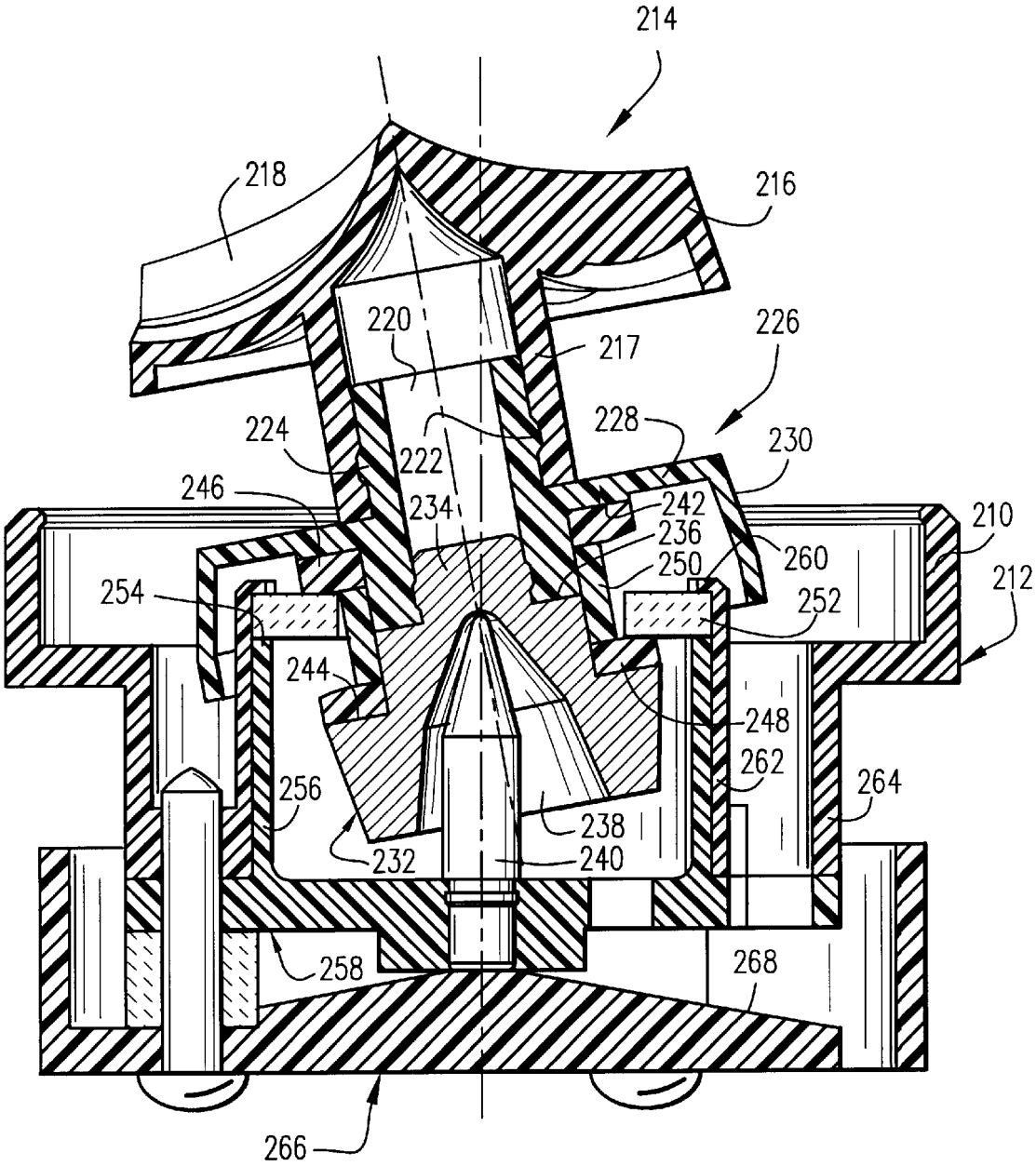
FIG. 8 is a cross section of the rotor plate assembly removed from the sprinkler of FIG. 7.
Figure 9:
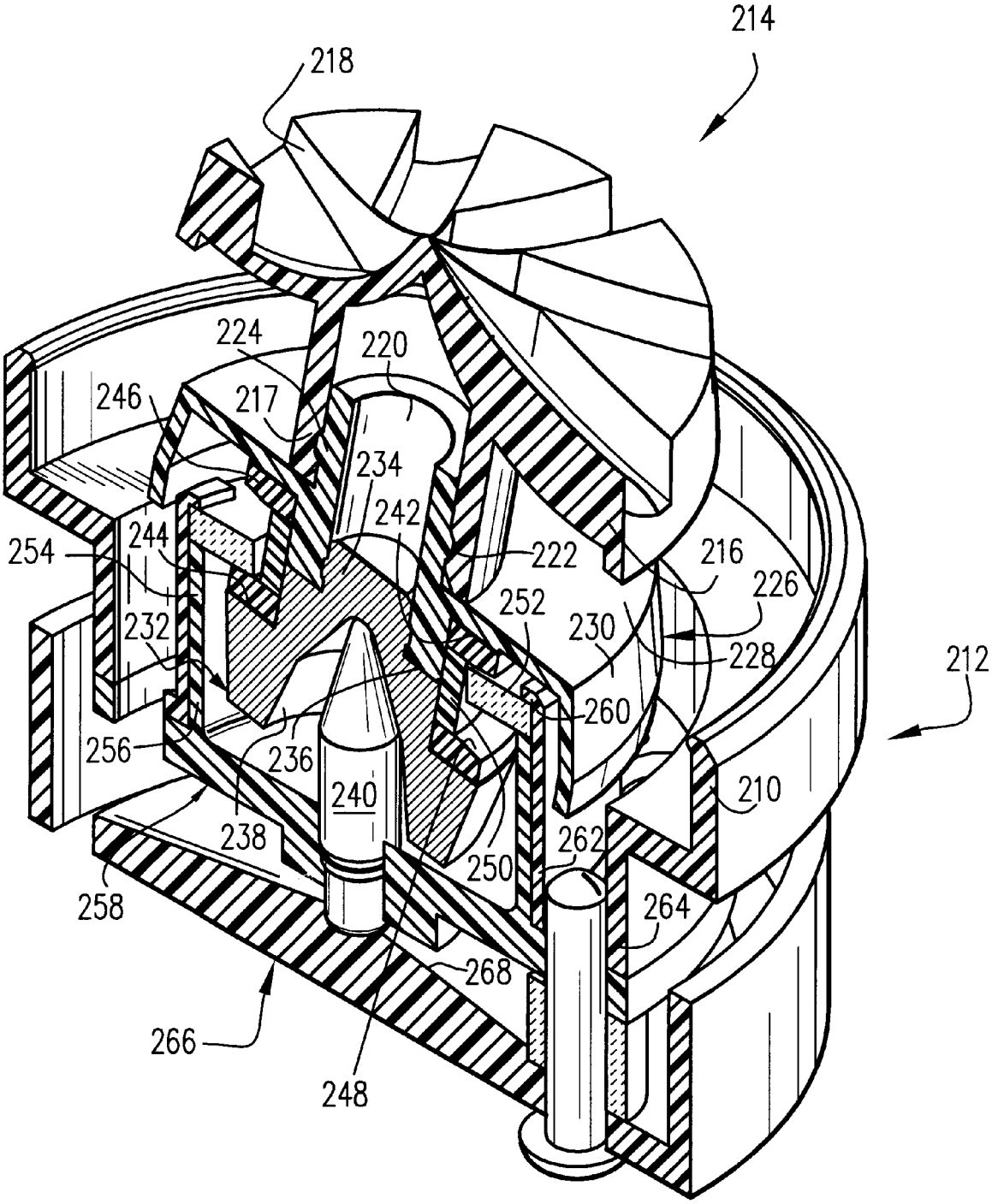
FIG. 9 is a cross section similar to FIG. 8 but from a perspective view.

FIGS. 7, 8 and 9 illustrate a preferred embodiment of the invention. The sprinkler body 204 in this :embodiment is shown without the adapter (see item 4 in FIG. 1), but is otherwise similar to sprinkler body 8 and includes a nozzle 206. In this embodiment, however, the means by which the nutator assembly 208 is attached to the sprinkler body 204 is altered somewhat in that the mating connection components lie radially within a skirt portion 210 of the cap center body 212. Any suitable connection may be employed, however, and this is not a significant aspect of the invention. With specific reference to FIGS. 8 and 9, the rotor plate 214 includes a rotor body 216 having an open-ended cylindrical stem 217 extending away from the water distributing grooves 218 in the external surface of the rotor plate. The stem is adapted to receive in snap-fit relationship, an upper hub component 220 of a two part spool bearing assembly. This snap-fit relationship is achieved through the use of an annular groove 222 in the cylindrical stem 217 and a complementary annular rib 224 formed on the exterior surface of the upper component 220. It will be understood that other suitable fastening arrangements may be employed. The upper hub component 220 of the spool bearing assembly is externally shaped to provide an umbrella-like shield 226 which serves to protect the lower portion of the spindle bearing assembly from dirt and debris as will be explained further below. The shield includes a flat, horizontal surface 228 (assuming an upright orientation of the rotor plate) and a depending annular skirt 230.

The lower component 232 of the spool bearing assembly includes a reduced diameter upper cylindrical projecting portion 234 that allows the lower component 232 to be snap-fit within the upper hub component 220 in the same manner as the upper hub component 220 is snap-fit within the cylindrical stem 217 of the rotor plate, i.e., with a rib fitting in a groove, such that a radial shoulder 236 of the lower component 232 engages the end of the upper hub component 220.

The lower spool bearing component 232 is preferably constructed of brass (or other similarly weighted material), and is formed with a generally conical shaped cavity 238 adapted to receive the tilter post 240. In this preferred embodiment, the lower spool component 232 is sized and shaped to provide sufficient mass to statically balance the moving parts about the center of nutation that lies substantially at the tip of post 240. The arrangement nevertheless provides the required instability with respect to the post 240 to insure an off-center orientation of the rotor plate 214 when at rest. This arrangement is expected to produce smoother operation with less vibration and thus more uniform water distribution The size and shape of cavity 238 is sufficient to allow a full range of nutating movement of the rotor plate relative to the fixed post 240.

The spool bearing assembly also includes bearing elements or bushings between opposed radial flanges 242, 244 on the upper and lower components, respectively. Specifically, upper and lower urethane washers 246, 248 engage the surfaces 242, 244 and form upper and lower spool bearing flanges. These flanges are separated from each other by a cylindrical spacer 250 which is preferably constructed of ultra-high molecular weight polyethylene (or other similarly wear-resistant material).

An annular ceramic disk 252 is captured between an upper edge 254 of a cylindrical extension 256 of the end cover or cap 258, and an in-turned flange 260 on an adjacent radially inner cylindrical portion 262 of the cap center body 212. The ceramic disk 252 projects radially into the space defined by bearing flanges 246, 248 and spacer 250, thus limiting the movement of the rotor plate and spindle bearing assembly. Note that the upper and lower bearing flanges 246, 248 provide wear resistant surfaces that are engaged with upper and lower surfaces of the ceramic disk 252 during nutation.

In this embodiment, the post 240 is constructed of stainless steel and is secured within the end cover or cap 258, preferably during injection molding of the cap. Utilization of the stainless steel post 240 and brass spool bearing component 232 improves both the durability and reliability of the device, while the brass component 232 provides the weight necessary to balance the parts as mentioned above.

It is also a feature of this preferred embodiment of the invention, that the cap center body 212, and particularly the radially outer skirt portion 210 and radially offset skirt portion 264 each have a relatively large inside diameter as compared to the diameter of radially inner cylindrical portion 262 to allow clearance for the nutating motion of the shield 226. In addition, the large radial spacing between components allows debris to flush through the cap and fall away during operation.

An optional deflector plate 266 may be secured to the bottom of a cap assembly to deflect particles and/or debris down and away via inclined surface 268, preventing entrance into the spool bearing area. The deflector plate 266 may be attached through the use of screws, snap-fit attachments or other suitable means.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A nutating sprinkler assembly comprising:

a sprinkler body having one end adapted to be coupled to a water supply conduit and an opposite end supporting a nozzle;

at least one arm extending from said sprinkler body for supporting a removable cap assembly downstream of said nozzle, said cap assembly having a center body supporting a rotor plate having off-center grooves for distributing a stream exiting said nozzle and impinging upon said grooves;

a spool bearing assembly having upper and lower bearing flanges; said center body mounting an interior ring loosely confining said spool bearing assembly and said rotor plate and between said upper and lower bearing flanges; said center body having an end wall formed with a post extending toward and received within a cavity of a lower spool bearing component of said spool bearing assembly, said spool bearing assembly resting on said post when said rotor plate is in an at-rest position, thereby creating an unstable arrangement causing said rotor plate to tilt to an off-center position, said lower spool bearing component comprised of a material of sufficient mass to balance said rotor plate and said spool bearing assembly when moving about a center of nutation.

2. The nutating sprinkler assembly of claim 1 wherein, during nutating motion of said rotor plate, surfaces of said upper and lower bearing flanges are engaged, respectively, with upper and lower surfaces of said interior ring.

3. The nutating sprinkler assembly of claim 2 wherein, during nutating movement of said rotor plate, said post is disengaged from said cavity.

4. The nutating sprinkler assembly of claim 1 wherein said post comprises a stainless steel post having a rounded point.

5. The nutating sprinkler assembly of claim 1 wherein said lower spool bearing component is comprised of brass.

6. The nutating sprinkler assembly of claim 1 wherein said upper and lower spool bearing flanges comprise urethane washers.

7. The nutating sprinkler assembly of claim 6 wherein said urethane washers are separated by a cylindrical spacer comprised of ultra high molecular weight polyethylene.

8. The nutating sprinkler assembly of claim 1 wherein said spool bearing assembly further comprises an upper hub component attached to said rotor plate, said upper hub component comprising an annular shield having a depending skirt.

9. The nutating sprinkler assembly of claim 8 wherein said upper bearing flange is engaged with an underside of said annular shield and said lower bearing flange is supported on a surface of said lower bearing component.

10. The nutating sprinkler assembly of claim 8 wherein said lower bearing component is formed with a cylindrical projection that is received within said upper hub component.

11. A rotor plate and a spool bearing assembly for a nutating sprinkler comprising a center body supporting the rotor plate, said rotor plate having off-center grooves adapted for distributing a stream exiting from a nozzle in the nutating sprinkler and impinging upon said grooves;

the spool bearing assembly having upper and lower bearing flanges; said center body mounting an interior ring loosely confining said spool bearing assembly and said rotor plate and between said upper and lower bearing flanges; said center body having an end wall formed with a post extending toward and received within a cavity of a lower spool bearing component of said spool bearing assembly, said spool bearing assembly resting on said post when said rotor plate is in an at-rest position, thereby creating an unstable arrangement causing said rotor plate to tilt to an off-center position, said lower spool bearing component comprised of a material of sufficient mass to balance said rotor plate and said spool bearing assembly when moving about a center of nutation.

12. The rotor plate and spool bearing assembly of claim 11 wherein said post comprises a stainless steel post having a rounded point.

13. The rotor plate and spool bearing assembly of claim 11 wherein said lower spool bearing component is comprised of brass.

14. The rotor plate and spool bearing assembly of claim 11 wherein said upper and lower spool bearing flanges comprise urethane washers.

15. The rotor plate and spool bearing assembly of claim 14 wherein said urethane washers are separated by a cylindrical spacer comprised of ultra high molecular weight polyethylene.

16. The rotor plate and spool bearing assembly of claim 11 wherein said spool bearing assembly further comprises an upper hub component attached to said rotor plate, said upper hub component comprising an annular shield having a depending skirt.

17. The rotor plate and spool bearing assembly of claim 16 wherein said upper bearing flange is engaged with an underside of said annular shield and said lower bearing flange is supported on a surface of said lower bearing component.

18. The rotor plate and spool bearing assembly of claim 16 wherein said lower bearing component is formed with a cylindrical projection that is received within said upper hub component.

19. An assembly for a nutating sprinkler comprising a center body supporting a rotor plate for rotation and nutation, said rotor plate having off-center grooves adapted for distributing a stream exiting a nozzle in the nutating sprinkler and impinging upon said grooves; and a spool bearing assembly having upper and lower bearing flanges; said center body mounting an interior ring loosely confining said spool bearing assembly and said rotor plate and between said upper and lower bearing flanges; said center body having an end wall provided with a post having a pointed end extending toward and received within a cavity of a lower spool bearing component of said spool bearing assembly, said spool bearing assembly engaging said pointed end when said rotor plate is in an at-rest position, thereby creating an unstable arrangement causing said rotor plate to tilt to an off-center position, to thereby insure that the rotor plate will nutate as it rotates when the stream impinges upon said grooves.

* * * * *

UNITED STATES PATENT AND TRADEMARK OFFICE

CERTIFICATE OF CORRECTION

PATENT NO. : 6,439,477 B1 
DATED : August 27, 2002
INVENTOR(S) : Sweet, Fred J. and Nelson, Craig B.

It is certified that error appears in the above-identified patent and that said Letters Patent is hereby corrected as shown below:

Column 1,
Line 36, delete “donut shaped” and insert -- donut-shaped --.

Column 2,
Line 1, delete “at rest” and insert -- at-rest --.
Line 18, delete “centerbody” and insert -- center body --.

Column 3,
Line 50, after “24” insert -- (as shown in FIG. 2) --.
Line 51, after “26” insert -- (as shown in FIG. 2) --.
Lines 54, 55 and 59, delete “centerbody” and insert -- center body --.
Line 66, after “16” insert -- (as shown in FIG. 1) --.

Column 4,
Line 14, delete “ring 40” and insert -- flange 40 --.
Line 15, after “2” insert -- (as shown in FIG. 1) --.
Lines 29, 49 and 51, delete “centerbody” and insert -- center body --.

Column 5,
Lines 39 and 43, delete “centerbody” and insert -- center body --.

Column 6,
Line 4, delete “centerbody” and insert -- center body --.
Line 14, delete “:embodiment” and insert -- embodiment --.
Line 16, after “8” insert -- (as shown in FIG. 1) --.
Line 28, delete “two part spool bearing” and insert -- two-part spool bearing --.
Lines 36 and 37, delete “spindle bearing” and insert -- spool bearing --.
Line 52, delete “conical shaped” and insert -- conical-shaped --.
Line 62, after “distribution” insert -- . --.

UNITED STATES PATENT AND TRADEMARK OFFICE

CERTIFICATE OF CORRECTION

PATENT NO. : 6,439,477 B1 
DATED : August 27, 2002
INVENTOR(S) : Sweet, Fred J. and Nelson, Craig B.

It is certified that error appears in the above-identified patent and that said Letters Patent is hereby corrected as shown below:

Column 7,
Line 7, delete "similarly" and insert -- similar --.

Signed and Sealed this

Sixteenth Day of December, 2003

JAMES E. ROGAN
*Director of the United States Patent and Trademark Office*